US011703786B2

(12) United States Patent
Shimodaira et al.

(10) Patent No.: US 11,703,786 B2
(45) Date of Patent: Jul. 18, 2023

(54) FIXING DEVICE AND IMAGE-FORMING APPARATUS

(71) Applicant: FUJIFILM BUSINESS INNOVATION CORP., Tokyo (JP)

(72) Inventors: Yoshiki Shimodaira, Ebina (JP); Masato Yamashita, Ebina (JP); Tetsuro Kodera, Ebina (JP); Mitsuhiro Matsumoto, Ebina (JP); Kosuke Yamada, Ebina (JP); Takayuki Yamashita, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/529,506

(22) Filed: Nov. 18, 2021

(65) Prior Publication Data

US 2022/0075303 A1 Mar. 10, 2022

Related U.S. Application Data

(63) Continuation of application No. PCT/JP2019/051613, filed on Dec. 27, 2019.

(30) Foreign Application Priority Data

Jun. 18, 2019 (JP) ..... 2019-112508

(51) Int. Cl.
*G03G 15/20* (2006.01)

(52) U.S. Cl.
CPC ..... *G03G 15/2064* (2013.01); *G03G 15/2021* (2013.01); *G03G 15/2039* (2013.01)

(58) Field of Classification Search
None
See application file for complete search history.

(56) References Cited

U.S. PATENT DOCUMENTS 6,252,654 B1 * 6/2001 Kaya ..... G03G 15/6502 355/75
2003/0165763 A1 * 9/2003 Nakamura ..... G03G 9/0928 430/108.1

(Continued)

FOREIGN PATENT DOCUMENTS

EP 3 026 500 A1 6/2016
JP 2011-043683 A 3/2011

(Continued)

OTHER PUBLICATIONS

Feb. 10, 2020 Written Opinion issued in International Patent Application No. PCT/JP2019/051613.

(Continued)

*Primary Examiner* — Sevan A Aydin
(74) *Attorney, Agent, or Firm* — Oliff PLC

(57) ABSTRACT

A fixing device includes: a non-contact heating unit configured to heat a recording medium in a non-contact manner; and a contact heating unit configured to press and heat the recording medium on a downstream side of the non-contact heating unit in a conveyance direction of the recording medium, in which the non-contact heating unit controls an amount of heat applied to the recording medium according to information on whether the recording medium is black or not, and a thickness of the recording medium, and the contact heating unit controls the pressure applied to the recording medium according to the thickness regardless of whether the recording medium is black or not.

4 Claims, 15 Drawing Sheets

(56) References Cited

U.S. PATENT DOCUMENTS

| | | | | |
|---|---|---|---|---|
| 2009/0081574 | A1* | 3/2009 | Hasegawa | G03G 9/0912 430/108.21 |
| 2010/0322680 | A1 | 12/2010 | Stelter | |
| 2016/0154345 | A1 | 6/2016 | Nagata | |

FOREIGN PATENT DOCUMENTS

| | | | | | |
|---|---|---|---|---|---|
| JP | 2011081374 | A | * | 4/2011 | G03G 9/0804 |
| JP | 2011-137963 | A | | 7/2011 | |
| JP | 2011-191521 | A | | 9/2011 | |
| JP | 2019-060998 | A | | 4/2019 | |

OTHER PUBLICATIONS

Feb. 10, 2020 International Search Report issued in International Patent Application No. PCT/JP2019/051613.
May 23, 2023 Extended European Search Report issued in European Patent Application No. 19933947.4.

* cited by examiner

FIG.11

LOW: Condition in which pressing force is low
HIGH: Condition in which pressing force is high

| PRESSING FORCE OF CONTACT FIXING PORTION | | SHEET MASS ($g/m^2$) | | | | |
|---|---|---|---|---|---|---|
| SHEET TYPE | SHEET COLOR | 60-79 | 80-105 | 106-169 | 170-256 | 257-300 |
| PLAIN SHEET | WHITE | LOW | LOW | HIGH | HIGH | HIGH |
| PLAIN SHEET | BLACK | LOW | LOW | HIGH | HIGH | HIGH |
| METALLIC SHEET | - | LOW | LOW | HIGH | HIGH | HIGH |

FIXING DEVICE AND IMAGE-FORMING APPARATUS

CROSS-REFERENCE TO RELATED APPLICATIONS

This is a continuation of International Application No. PCT/JP2019/051613 filed on Dec. 27, 2019, and claims priority from Japanese Patent Application No. 2019-112508 filed on Jun. 18, 2019.

BACKGROUND

Technical Field

The present invention relates to a fixing device and an image forming apparatus.

Related Art

There is known a fixing device including: a fixing mechanism portion having a nip portion for fixing a toner on a recording medium by heat and pressure; and a preheating mechanism portion disposed on an upstream side in a recording medium conveyance direction of the fixing mechanism portion and configured to heat the recording medium conveyed in a non-contact manner, wherein the preheating mechanism portion includes heating elements sequentially arranged in a recording medium conveyance direction in a state of being close to the conveyed recording medium and to be in a heat generating state during fixing processing, and a shutter disposed between the heating elements and the recording medium conveyance path and capable of adjusting the number of heating elements to be exposed to the recording medium conveyed among the heating elements by performing opening/closing control of a shield that blocks radiation heat from the heating elements to the recording medium, wherein an opening degree of the shutter in the preheating mechanism portion is adjusted based on at least one of a surface glossiness, a thickness, and a whiteness of the recording medium (Patent Literature 1).

There is also known an image forming apparatus including: a fixing device configured to convey a recording medium to a nip portion formed between a fixing member controlled to a predetermined temperature by a heating unit and a pressing member configured to come into pressure contact with the fixing member to fix a toner image on a surface of the recording medium; a recording medium heating device configured to heat the recording medium at an upstream portion of the fixing device; a glossiness measuring unit configured to measure a glossiness of the surface of the recording medium after the toner image is fixed by the fixing device; and a changing unit configured to change and control a heating condition of the recording medium heating device based on the glossiness measured by the glossiness measuring unit, wherein the recording medium heating device heats the recording medium by irradiation of far-infrared rays (Patent Literature 2).

CITATION LIST

Patent Literature

Patent Literature 1: JP-A-2011-137963
Patent Literature 2: JP-A-2011-43683

SUMMARY

Aspects of non-limiting embodiments of the present disclosure relate to a fixing device and an image forming apparatus capable of obtaining sufficient fixing characteristics in consideration of an influence of each condition on fixing characteristics even when recording media have different thicknesses, colors, and sheet types.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device of a first aspect including:

a non-contact heating unit configured to heat a recording medium in a non-contact manner; and a contact heating unit configured to press and heat the recording medium on a downstream side of the non-contact heating unit in a conveyance direction of the recording medium, in which the non-contact heating unit controls an amount of heat applied to the recording medium according to information on whether the recording medium is black or not, and a thickness of the recording medium, and the contact heating unit controls the pressure applied to the recording medium according to the thickness regardless of whether the recording medium is black or not.

BRIEF DESCRIPTION OF DRAWINGS

Exemplary embodiment(s) of the present invention will be described in detail based on the following figures, wherein:

FIG. 11 is a diagram illustrating an example of a table in which a pressing condition of a contact fixing portion of the image forming apparatus according to a second exemplary embodiment is set;

DETAILED DESCRIPTION

Figure 1:
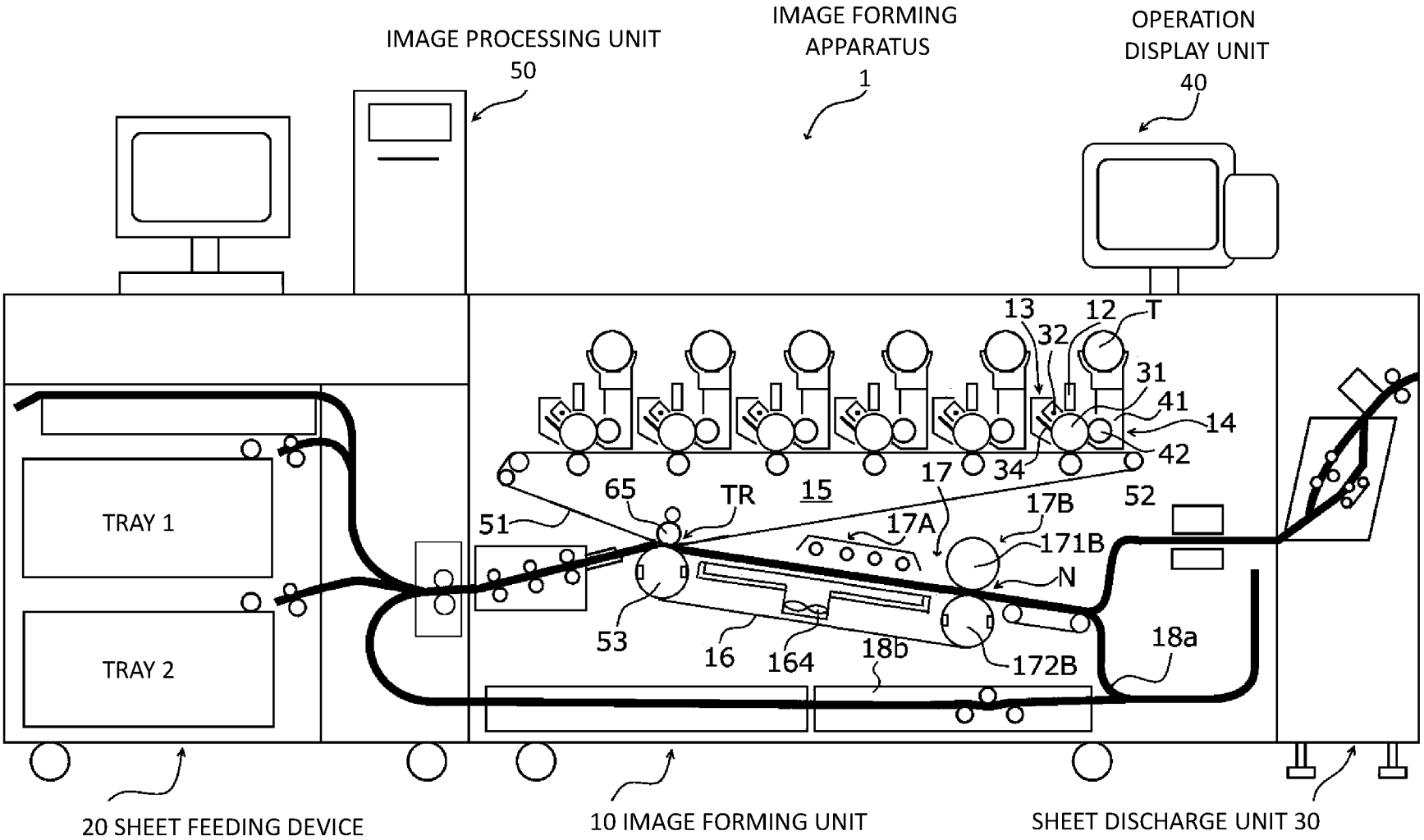
FIG. 1 is a schematic cross-sectional view illustrating an example of a schematic configuration of an image forming apparatus including a fixing device according to a first exemplary embodiment.

Next, the present disclosure will be described in more detail with reference to the drawings with reference to the following exemplary embodiments and specific examples, but the present disclosure is not limited to these exemplary embodiments and specific examples.

In the following description using the drawings, the drawings are schematic, and it should be noted that ratios of dimension and the like are different from actual ones, and illustration of members other than those necessary for the description is omitted as appropriate in order to easy understanding.

In order to facilitate understanding of the following description, in the drawings, a front-rear direction is referred to as an X-axis direction, a left-right direction is referred to as a Y-axis direction, and an up-down direction is referred to as a Z-axis direction.

First Exemplary Embodiment (1) Overall Configuration and Operation of Image Forming Apparatus (1.1) Overall Configuration of Image Forming Apparatus FIG. 1 is a schematic cross-sectional view illustrating an example of a schematic configuration of an image forming apparatus 1 including a fixing device 17 according to an exemplary embodiment.

The image forming apparatus 1 includes an image forming unit 10, a sheet feeding device 20 attached to one end of the image forming unit 10, a sheet discharge unit 30 provided at another end of the image forming unit 10 and configured to eject a printed sheet, an operation display unit 40, and an image processing unit 50 configured to generate image information from printing information transmitted from an upper device.

The image forming unit 10 includes a system control device 11 (not shown), exposure devices 12, photoconductor units 13, developing devices 14, a transfer device 15, a sheet conveying device 16, and a fixing device 17. The image forming unit 10 forms image information received from the image processing unit 50 as a toner image on a sheet fed from the sheet feeding device 20.

The sheet feeding device 20 supplies various types of sheet as a recording medium used for image formation to the image forming unit 10. That is, the sheet feeding device 20 includes sheet loading units (trays 1, 2) that accommodate sheets of different types (for example, material, thickness, sheet size, and grain), and is configured to supply a sheet fed out from any one of the sheet loading units (trays 1, 2) to the image forming unit 10.

The sheet discharge unit 30 discharges the sheet on which image output is performed in the image forming unit 10. Therefore, the sheet discharge unit 30 includes a discharge sheet accommodating unit to which the sheet after the image output is discharged. The sheet discharge unit 30 may have a function of performing a post-processing such as cutting and stapling (staple binding) on a sheet bundle output from the image forming unit 10.

The operation display unit 40 is used for inputting various settings and instructions and displaying information. That is, the operation display unit corresponds to what is called a user interface, and is specifically configured by combining a liquid crystal display panel, various operation buttons, a touch panel, and the like.

(1.2) Configuration and Operation of Image Forming Unit

In the image forming apparatus 1 having such a configuration, the sheet is fed from the tray of the sheet feeding device 20 designated for each sheet of printing in a print job to the image forming unit 10 in accordance with a timing of image formation.

The photoconductor units 13 are provided in parallel below the exposure device 12. Each of the photoconductor units 13 includes a photoconductor drum 31 as an image holder to be rotationally driven. A charging device 32, the exposure device 12, the developing device 14, a primary transfer roller 52, and a cleaning device 34 are disposed along a rotation direction of each photoconductor drum 31.

The developing device 14 includes a developing housing 41 in which a developer is accommodated. A developing roller 42 that faces the photoconductor drum 31 is disposed in the developing housing 41, and forms a toner image on the photoconductor drum.

The developing devices 14 have substantially the same configuration except for the developer accommodated in the developing housing 41, and each forms a toner image of yellow (Y), magenta (M), cyan (C), black (K), white (W), and silver (S) as a special color, respectively.

Above the developing device 14, a replaceable toner cartridge T that accommodates the developer (a toner including a carrier) is disposed, and the developer is supplied from each toner cartridge T to the developing device 14.

A surface of the rotating photoconductor drum 31 is charged by the charging device 32, and an electrostatic latent image is formed by latent image forming light emitted from the exposure device 12. The electrostatic latent image formed on the photoconductor drum 31 is developed as a toner image by the developing roller 42.

The transfer device 15 includes an intermediate transfer belt 51, a primary transfer roller 52, and a secondary transfer roller 53. Each color toner image formed on the photoconductor drum 31 of each photoconductor unit 13 is multiply transferred to the intermediate transfer belt 51. The primary transfer roller 52 sequentially transfers (primarily transfers) the respective color toner images formed in the respective photoreceptor units 13 to the intermediate transfer belt 51. The secondary transfer roller 53 collectively transfers (secondarily transfer) the color toner images superimposed and transferred onto the intermediate transfer belt 51 onto the sheet.

The secondary transfer roller 53 is in contact with the backup roller 65 via the intermediate transfer belt 51 to form a secondary transfer portion (TR) between the secondary transfer roller 53 and the secondary transfer roller 53.

A predetermined transfer voltage is applied to the primary transfer roller 52 from a power supply device (not shown) controlled by the system control device 11. The color toner images formed on the photoconductor drums 31 of the photoconductor units 13 are sequentially electrostatically transferred (primarily transferred) onto the intermediate transfer belt 51 by the primary transfer rollers 52, and superimposed toner images in which the respective color toners are superimposed are formed on the intermediate transfer belt 51.

The superimposed toner images on the intermediate transfer belt 51 are transported to the secondary transfer portion TR in which the secondary transfer roller 53 is disposed with the movement of the intermediate transfer belt 51. When the superimposed toner images are transported to the secondary transfer unit TR, the sheet is supplied to the secondary transfer unit TR from the sheet feeding device 20 in accordance with the timing. In the secondary transfer portion TR, the backup roller 65 faces the secondary transfer roller 53 via the intermediate transfer belt 51. A predetermined transfer voltage is applied to the backup roller 65 from a power supply device or the like controlled by the system control device 11, and the multiple toner images on the intermediate transfer belt 51 are collectively transferred to the sheet passing through the secondary transfer portion TR.

The fixing device 17 includes a non-contact heating portion 17A and a contact fixing portion 17B. The non-contact heating portion 17A heats the sheet conveyed by the sheet conveying device 16 in a non-contact manner. The contact fixing portion 17B is disposed on the downstream side of the non-contact heating portion 17A, and fixes the toner image on the sheet by the action of heating and pressure bonding.

The sheet P on which the toner image is transferred in the transfer device 15 is transported to the fixing device 17 via the sheet transport device 16 in a state where the toner image is not fixed. The sheet conveyed to the fixing device 17 is preliminarily heated by the non-contact heating portion 17A, and the toner image is fixed by heating and pressure bonding by a pair of a fixing roller 171B and a pressure roller 172B in the contact fixing portion 17B.

The sheet P on which the fixing has been completed is sent to the sheet discharge unit 30. When image output is performed on both sides of the sheet P, the front and back of the sheet P are reversed by a sheet conveying device 18*a*, and the sheet P is again fed to the secondary transfer portion TR in the image forming unit 10 via a sheet conveying device 18*b*. After the transfer of the toner image and the fixing of the transferred image are performed, the sheet P is fed to the sheet discharge unit 30. The sheet P fed to the sheet discharge unit 30 is subjected to post-processing such as cutting and stapling as necessary.

(2) Configuration of Sheet Conveying Device and Fixing Device

Figure 2:
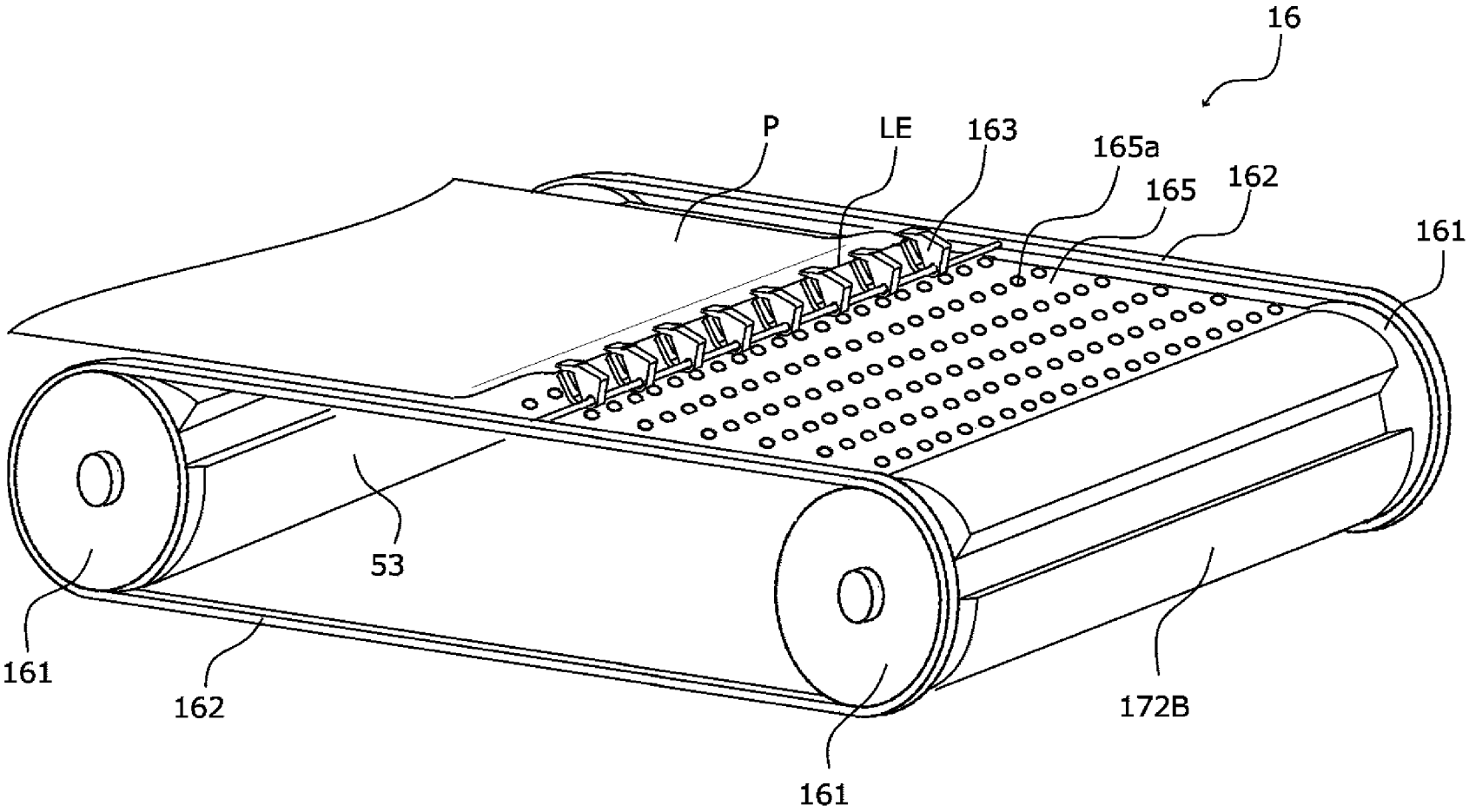
FIG. 2 is a perspective view illustrating a schematic configuration of a sheet conveying device.
Figure 3:
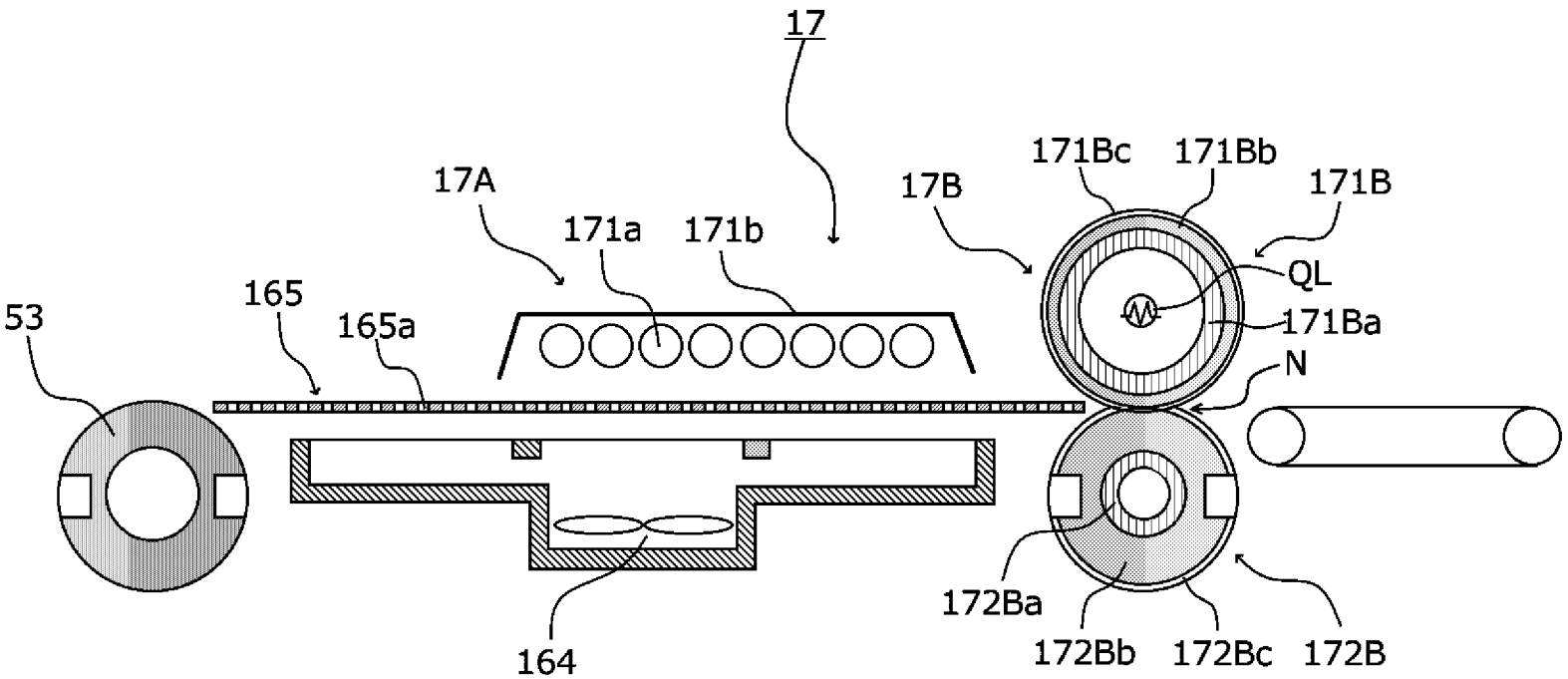
FIG. 3 is a schematic cross-sectional view illustrating a schematic configuration of a fixing device including a sheet conveying device.

FIG. 2 is a perspective view illustrating a schematic configuration of the sheet conveying device 16, and FIG. 3 is a schematic cross-sectional view illustrating a schematic configuration of the fixing device 17 including the sheet conveying device 16 of the image forming apparatus 1 according to the present exemplary embodiment.

The fixing device 17 includes the non-contact heating portion 17A as an example of a non-contact heating unit and the contact fixing portion 17B as an example of a contact heating unit.

(2.1) Sheet Conveying Device

As an example, the sheet conveying device 16 includes an endless chain member 162 wound and circularly moved around sprockets 161, grippers 163 provided at intervals in a peripheral direction of the chain member 162, an air blower 164 (see FIGS. 1 and 3) for blowing air from the back surface side of the sheet P to the conveyed sheet P to float the sheet P, and a sheet guide plate 165 having a large number of air holes 165*a* through which the blown air passes.

The chain member 162 is circularly moved when the sprocket 161 is rotated around Y direction as an axial direction by a motor (not shown). The gripper 163 is driven by a motor (not shown) to grip the downstream end portion (leading end portion LE) of the sheet P in the conveying direction at a set timing or to release the gripped sheet P at a set timing.

In the sheet conveying device 16, when the grippers 163 receive the sheet P in the secondary transfer portion TR, the chain members 162 move while floating the sheet P over the sheet guide plate 165 with the air blown from the air blower 164, whereby the grippers 163 convey the sheet P toward the contact fixing portion 17B.

The sheet P is conveyed on the sheet guide plate 165 while being given a predetermined amount of heat by a non-contact heating unit 17A, which will be described later.

(2.2) Non-Contact Heating Portion

The non-contact heating portion 17A is sequentially arranged in the sheet conveying direction in a state in which the non-contact heating portion 17A is close to the sheet P being conveyed. The non-contact heating portion 17A includes heating elements 171*a* such as halogen lamps that are in a heat generation state by energization and emit far-infrared rays (radiation heat), and a reflection plate 171*b* that reflects far-infrared rays (radiation heat) from the heating elements 171*a* toward the sheet guide plate 165 to increase heating efficiency of the heating elements 171*a* with respect to the sheet P. The non-contact heating portion 17A preliminarily heats the sheet P from the transfer toner surface side on which the unfixed toner is transferred (the upper surface side of the sheet P in the drawing) in a non-contact manner before the sheet P on which the unfixed toner is transferred is conveyed to the contact fixing portion 17B.

In the present exemplary embodiment, the heating elements 171*a* are installed at intervals of 30 mm. The non-contact heating portion 17A is provided with a wire mesh (not shown) for preventing the sheet P from entering the heating elements 171*a*. The non-contact heating portion 17A may change the amount of heat applied to the sheet P by changing the number of lit heating elements 171*a* at a predetermined sheet conveying speed (process speed).

Figure 4:
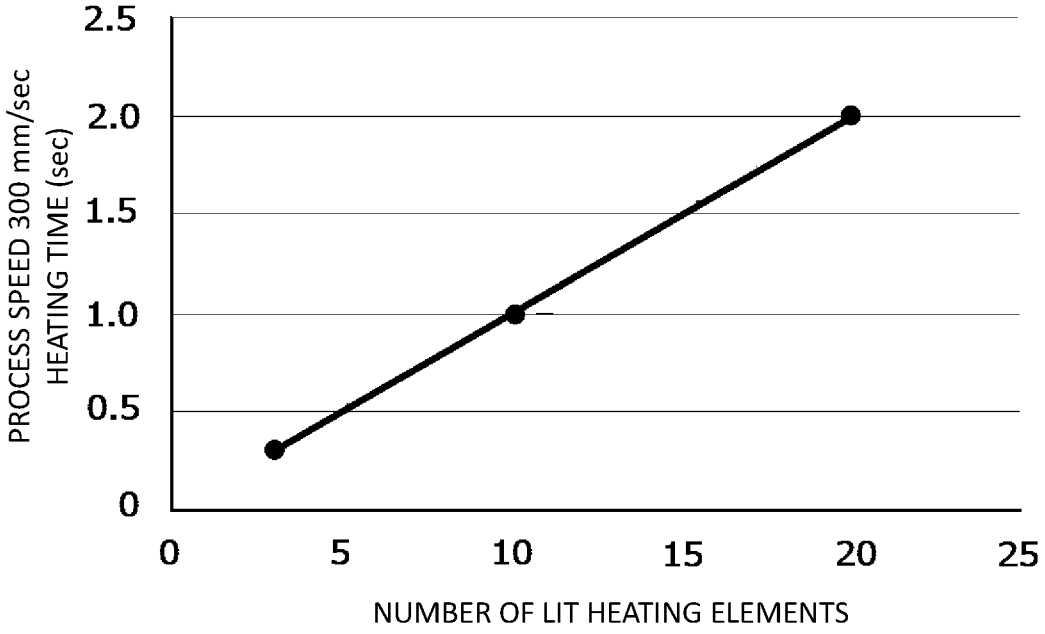
FIG. 4 is a diagram illustrating an example of a relationship between a heating time at a process speed of 300 mm/sec and a number of lit heating elements.

FIG. 4 illustrates an example of the relationship between the heating time at the process speed of 300 mm/sec and the number of the lit heating elements 171*a*. As illustrated in FIG. 4, by increasing the number of the lit heating elements 171*a*, it is possible to increase the heating time and increase the amount of heat applied to the sheet P.

The amount of heat applied to the sheet P may be increased or decreased by changing the amount of power supplied to the heating elements 171*a* and changing the surface temperature of the heating elements 171*a*, or the amount of heat applied to the sheet P may be changed by changing the process speed.

(2.3) Contact Fixing Portion

The contact fixing portion 17B is disposed on the downstream of the non-contact heating portion 17A in the sheet conveying direction. The contact fixing portion 17B includes a heating roller 171B and a pressure roller 172B. A heater QL constituted by, for example, a halogen heater is provided inside the heating roller 171B. The heater QL heats the surface of the heating roller at a predetermined temperature.

The heating roller 171B includes: a support 171Ba formed of, for example, a metal having rigidity, for example, aluminum or the like; an elastic body layer 171Bb laminated on the front surface side (outer peripheral surface side) of the support 171Ba and made of, for example, silicone rubber; and a release layer 171Bc coated on the elastic body layer 171Bb and formed of, for example, PFA (tetrafluoroethylene perfluoroalkyl vinyl ether polymer) or the like.

For example, a metal cylindrical core material 172Ba, a heat-resistant elastic body layer 172Bb (for example, a silicone rubber layer or a fluorine rubber layer) coated on the outer circumferential surface of the core material 172Ba, and, as necessary, a release layer 172Bc formed of a heat-resistant resin coating such as PFA or a heat-resistant rubber coating are laminated to form the pressure roller 172B.

The heating roller 171B is disposed by being pressed against the pressure roller 172B by a moving mechanism (not shown), thereby forming a nip portion N in which the heating roller 171B and the pressure roller 172B come into contact with each other. The heating roller 171B is supported by the moving mechanism so as to be able to come into contact with and separate from the outer circumferential surface of the pressure roller 172B, and is in pressure contact with the pressure roller 172B at the nip portion N so as to apply a predetermined pressing force according to the thickness of the sheet P.

The moving mechanism may move the pressure roller 172B. However, when the pressure roller 172B is moved, the sprocket 161 is also moved, so that the tension state of the chain member 162 may change. Therefore, it is preferable that the moving mechanism moves the heating roller 171B.

In the fixing operation, the sheet P holding the unfixed toner image is passed through the nip portion N, so that the contact fixing portion 17B applies heat and pressure to the sheet P to fix the unfixed toner image on the sheet P.

Figure 5:
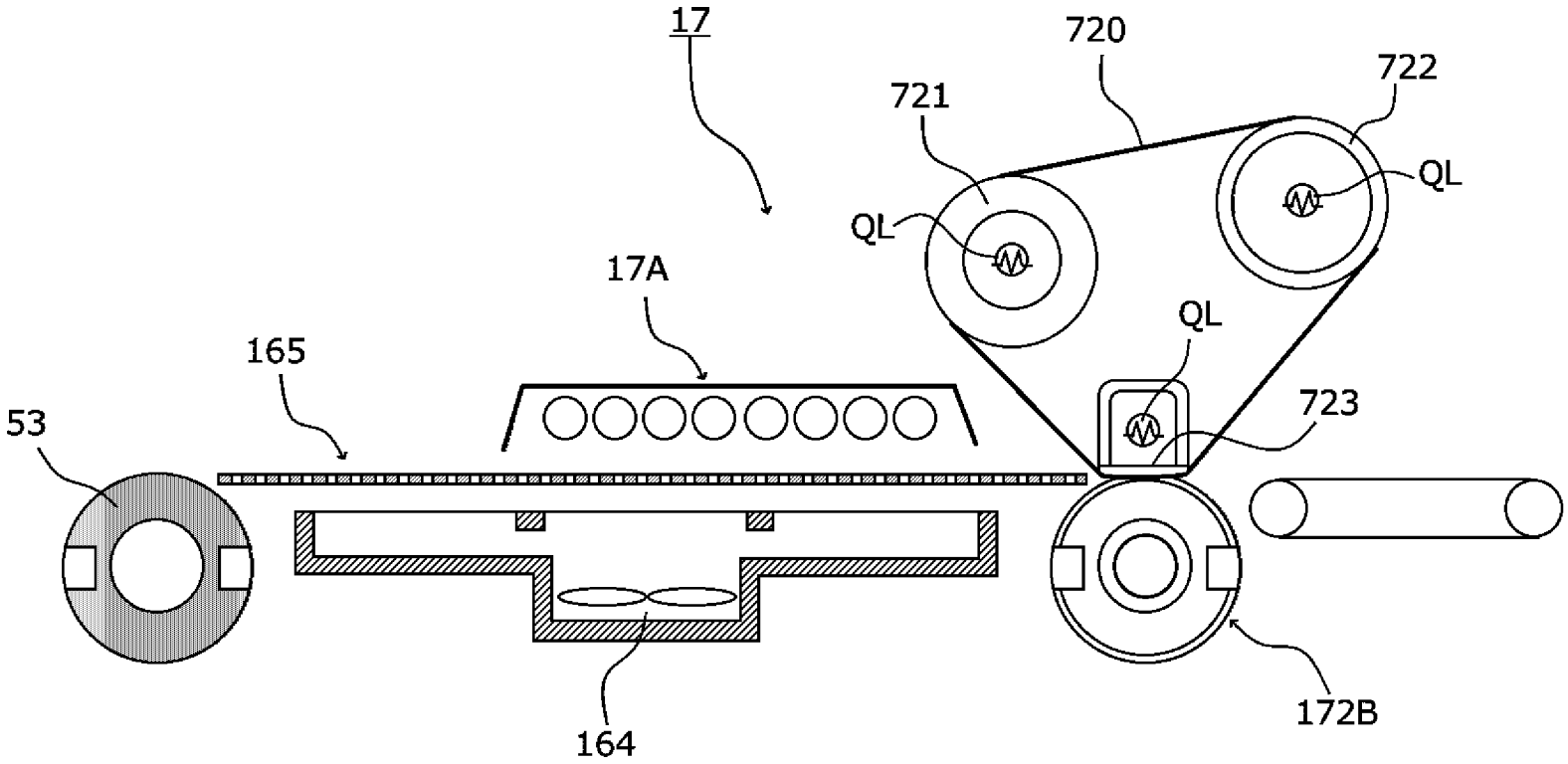
FIG. 5 is a schematic cross-sectional view illustrating a schematic configuration of another fixing device including the sheet conveying device.

FIG. 5 is a schematic cross-sectional view illustrating a schematic configuration of another fixing device 17 including the sheet conveying device 16.

As illustrated in FIG. 5, the contact fixing portion 17B may be a fixing belt module including a fixing belt 720, a first tension roller 721, a second tension roller 722, and a pressing member 723 instead of the heating roller 171B. The pressing member 723 is provided at a position facing the pressing roller 172B. The pressing member 723 sandwiches the fixing belt 720 with the pressure roller 172B, and receives a load from the pressure roller 172B. The pressure roller 172B and the pressing member 723 sandwich the sheet P from both sides and apply a pressure to the sheet P.

A heater QL for heating the first tension roller 721, the second tension roller 722, and the pressing member 723 is provided inside the first tension roller 721, the second tension roller 722, and the pressing member 723. The heater QL includes, for example, a halogen heater.

(3) Fixing Operation

Figure 6:
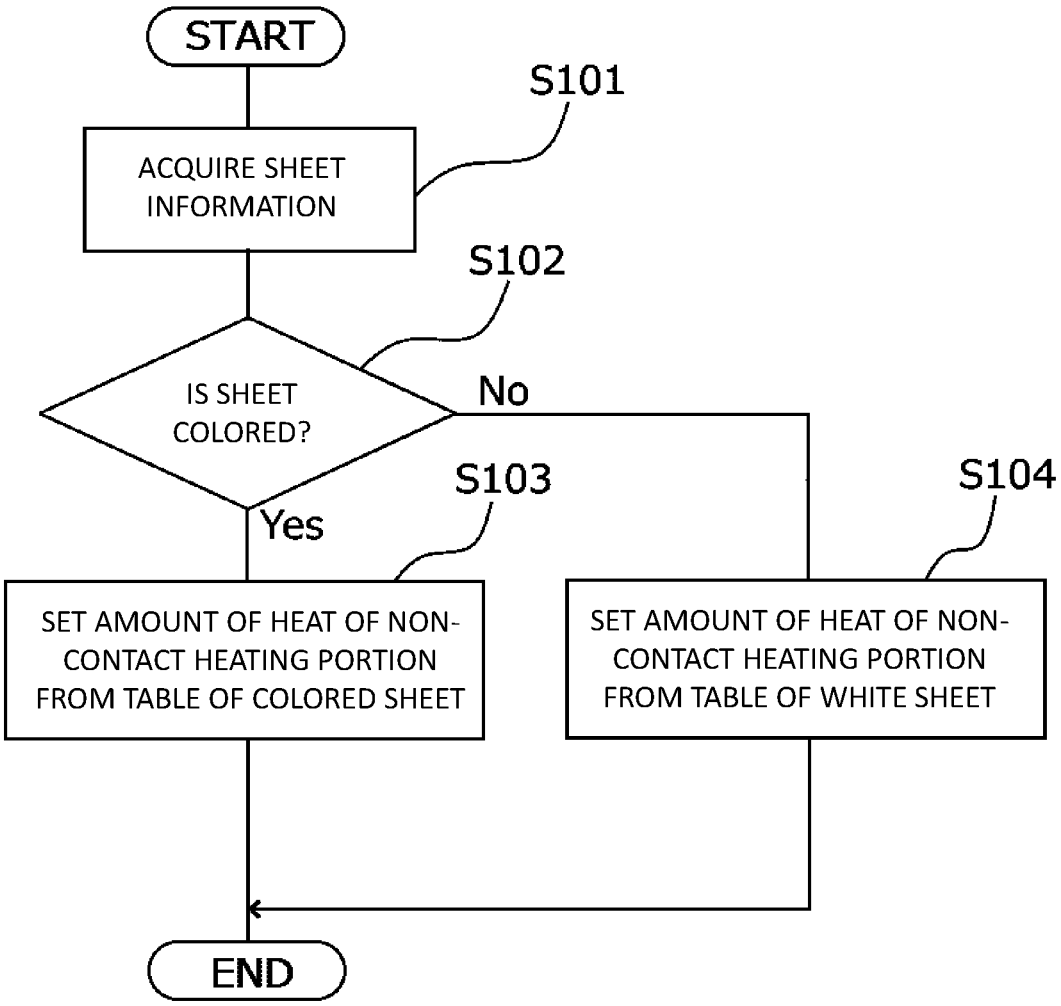
FIG. 6 is a flowchart illustrating a flow of a fixing operation of colored sheet.
Figure 7:
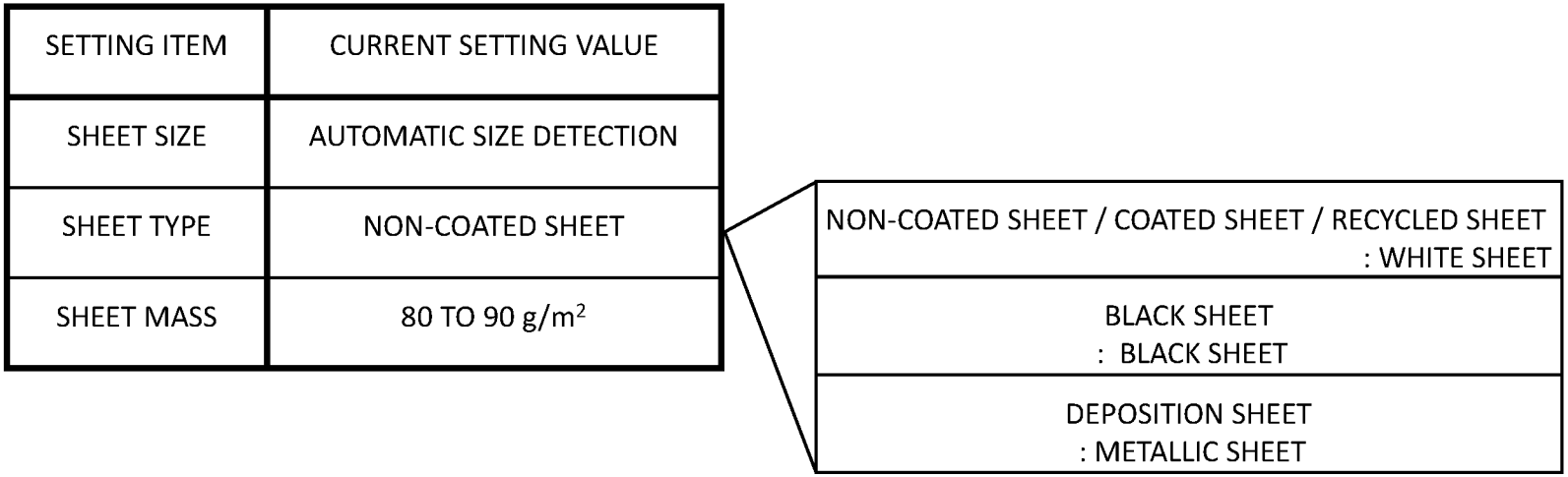
FIG. 7 is a diagram illustrating an example of sheet setting of a sheet tray of a sheet feeding device.

FIG. 6 is a flowchart illustrating the flow of the fixing operation of the colored sheet, and FIG. 7 is a diagram illustrating an example of the sheet setting of the sheet tray of the sheet feeding device 20. Hereinafter, a fixing operation in the fixing device 17 will be described with reference to the drawings.

In the fixing device 17, for example, the fixing temperature of the nip portion N in the contact fixing portion 17B is set constant, and the heating condition (amount of heat) of the non-contact heating portion 17A is changed according to the mass, color, and sheet type of the sheet P being conveyed.

For example, black sheet as an example of the colored sheet has a high infrared absorptivity as compared with white sheet of the same basis weight. In addition, the metallic sheet has a low infrared absorptivity. As described above, there is a concern that the fixing quality such as the fixing characteristics and the glossiness may change depending on the color or the sheet type of the sheet P.

For example, when the amount of heat applied to the sheet P is not increased as the mass of the sheet P increases, the fixing quality may decrease.

In the case of thin sheet, when the pressing condition in the contact fixing portion 17B is high pressure, paper wrinkles may occur.

(3.1) Fixing Operation of Colored Sheet

In the fixing device 17 according to the present exemplary embodiment, the non-contact heating portion 17A is controlled such that the amount of heat applied to the sheet P when the sheet P is colored is smaller than the amount of heat applied to the sheet P when the color of the sheet P is white. For example, a table in which the amount of heat of the non-contact heating portion 17A is set based on the color of the sheet P is stored in the system control device 11. When the sheet P is colored, the amount of heat applied to the sheet P when the sheet P is a white sheet is smaller than the amount of heat applied to the sheet P.

When the mass of the sheet is higher than the predetermined value, the amount of heat applied to the sheet P is increased as compared with a case where the mass of the sheet is low.

As described above, the amount of heat of the non-contact heating portion 17A is controlled based on the table in which the amount of heat of the non-contact heating portion 17A is set based on the mass and the color of the sheet P, and the fixing operation is performed based on the "mass" and the "color" information of the sheet P.

First, the image forming apparatus 1 acquires the sheet information of the sheet P used in the job (S101). Examples of the sheet information include the sheet type, the sheet color, and the sheet mass (basis weight), the sheet information may be detected by a sheet sensor (not shown) provided inside the image forming apparatus 1 or outside the image forming apparatus 1, or may be acquired from sheet information designated via the operation display unit 40 as illustrated in FIG. 7. For example, for the "sheet type" of the setting item, "white sheet" is set when "non-coated sheet/coated sheet/recycled sheet" is selected, "black sheet" is set when "black sheet" is selected, and "metallic sheet" is set when "deposition sheet" is selected. The sheet mass may be regarded as information indicating the thickness of the sheet. That is, as the sheet mass is higher, the thickness of the sheet tends to be thicker.

Next, it is determined whether or not the sheet P is colored (S102). The color of the sheet P may be determined to be colored when the color is a dark color other than white, such as black, blue, and red. The sheet type may be any of plain sheet, coated sheet, recycled sheet, and the like.

When it is determined that the sheet P is colored (S102: Yes), the amount of heat of the non-contact heating portion 17A is set from a table in which the sheet color is colored (for example, black) (S103). On the other hand, when it is determined that the sheet P is white (S102: No), the amount of heat of the non-contact heating portion 17A is set from the table in which the sheet color is white (S104). That is, when the sheet P is a black sheet, the amount of heat of the non-contact heating portion 17A is set to be relatively small. When the mass of the sheet is higher than the predetermined mass, the amount of heat applied to the sheet P is set to be larger than that in a case where the mass of the sheet is lower than the predetermined mass.

Thus, when the sheet P is a black sheet, the amount of heat applied to the sheet P in the case where the color of the sheet P is "white" is made smaller than the amount of heat applied to the sheet P in the case where the sheet P is black, and even when the sheet P is black, excessive heat absorption may be suppressed and sufficient fixing characteristics may be obtained.

Figure 8:
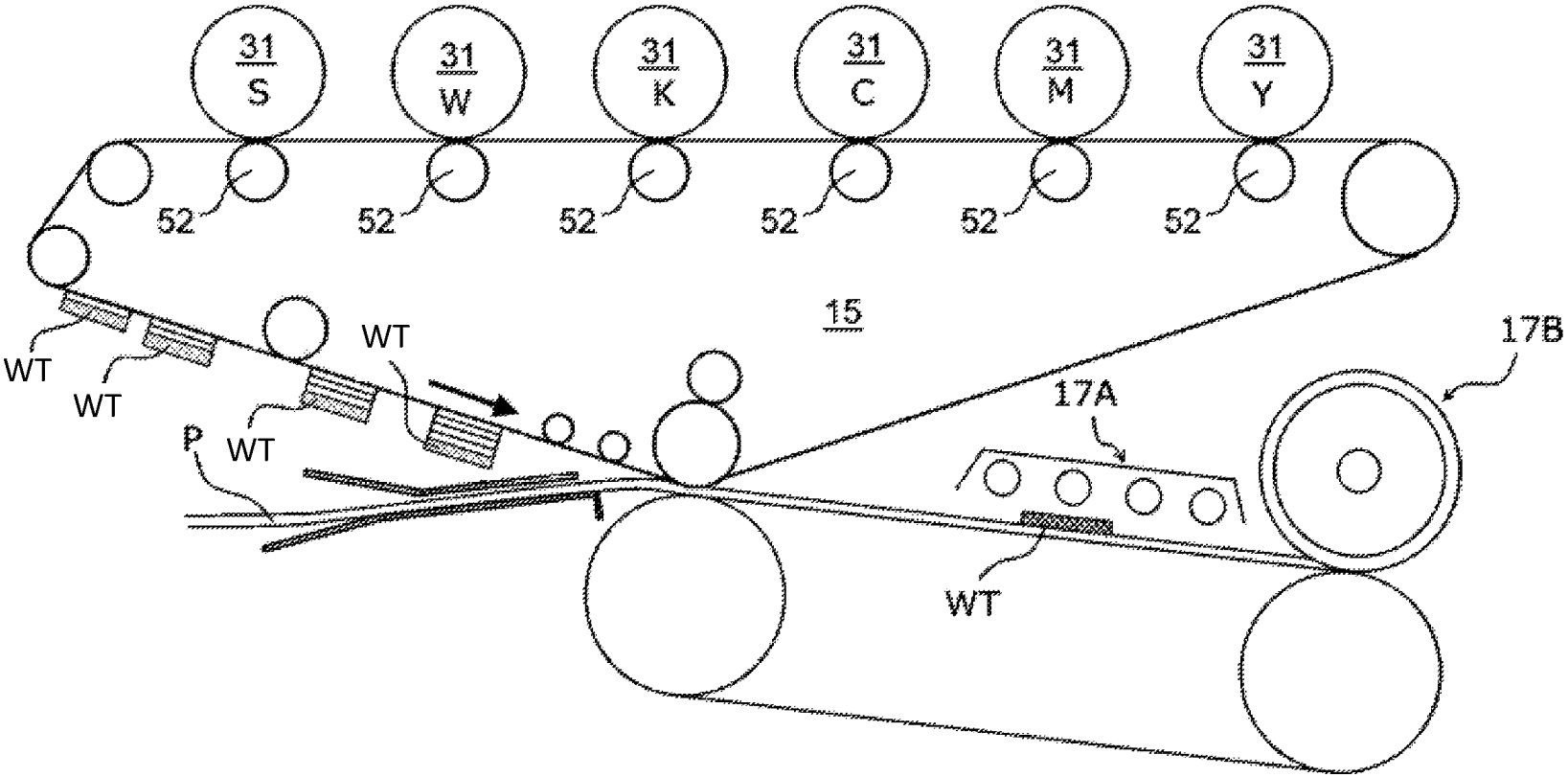
FIG. 8 is a view schematically illustrating a state in which color images with a white toner image are secondarily transferred onto a colored sheet.

FIG. 8 is a view schematically illustrating a state in which a white toner image WT is primarily transferred onto the colored sheet so as to overlap the superimposed toner images (YMCK), and the color images with the white toner image WT are secondarily transferred onto the colored sheet P.

As described above, in the case where the color images are formed by concealing the color of the colored sheet P with the white toner, the ratio of absorbing infrared light from the non-contact heating portion 17A is lower than in the case where the white toner is not used. Therefore, the amount of heat of the non-contact heating portion 17A may not be set to be smaller than the amount of heat applied to the sheet P when the color of the sheet P is "white". For example, the amount of heat of the non-contact heating portion 17A is set from the table in which the sheet color is white. However, when the amount of heat of the non-contact heating portion 17A is set to be higher than the condition in the case where the sheet color is colored, the condition in the case where the sheet color is white may not be used.

(3.2) Fixing Operation of Metallic Sheet

Figure 9:
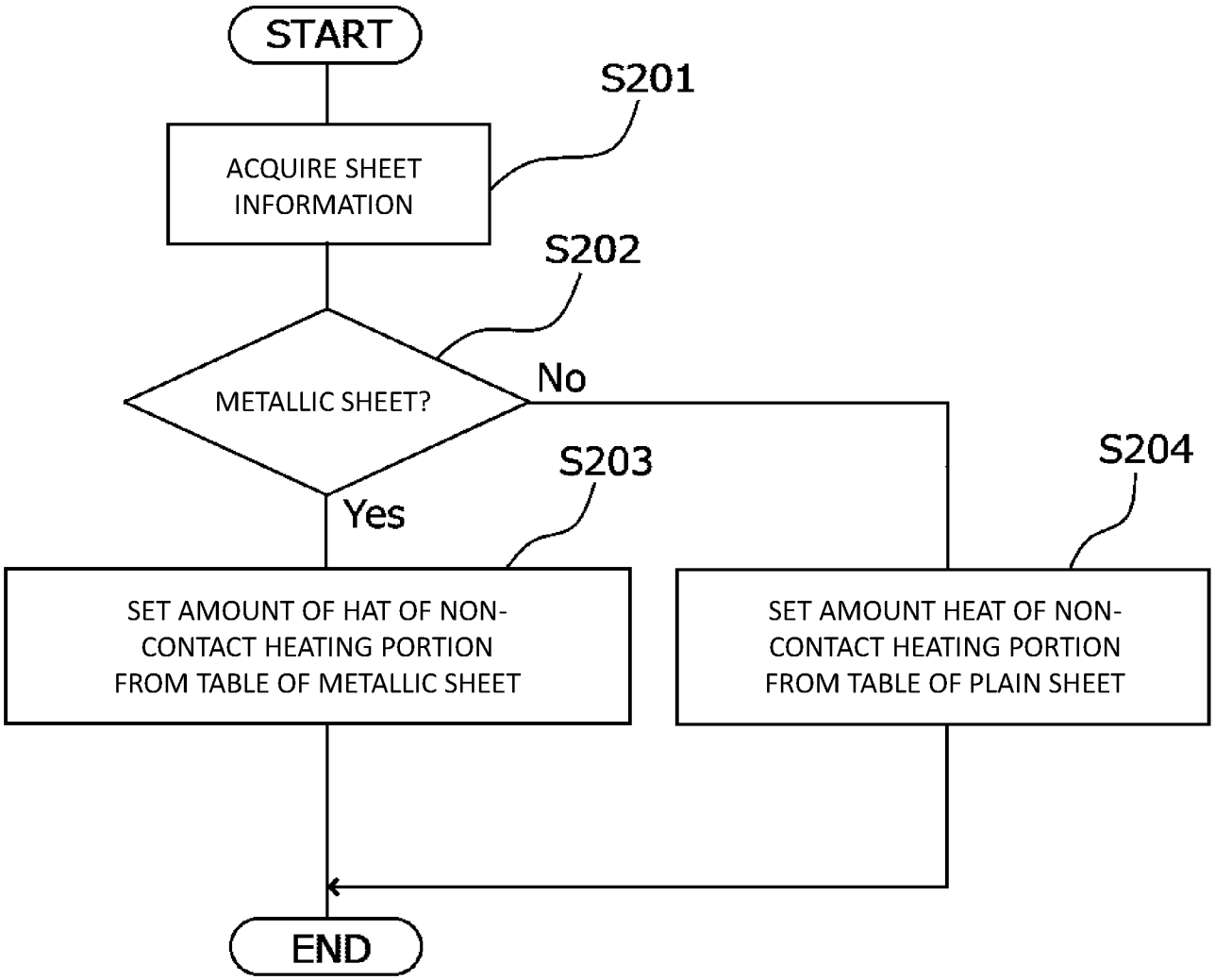
FIG. 9 is a flowchart illustrating a flow of a fixing operation of a metallic sheet.

FIG. 9 is a flowchart illustrating a flow of a fixing operation of a metallic sheet.

In the fixing device 17 according to the present exemplary embodiment, the non-contact heating portion 17A has a condition in which the amount of heat applied to the sheet P in the case where the sheet P is a metallic sheet is larger than the amount of heat applied to the sheet P in the case where the sheet P is plain sheet. For example, in the case where the sheet P is a metallic sheet, a condition in which the amount of heat applied to the sheet P in the case where the sheet P is plain sheet is larger than the amount of heat applied to the sheet P is set. In addition, when the mass of the sheet is higher than the predetermined value, the amount of heat applied to the sheet P is set to be larger than that in a case where the mass of the sheet is low.

The image forming apparatus 1 acquires the sheet information of the sheet P used in the job (S201).

Next, it is determined whether or not the sheet P is a "metallic sheet" (S202). When the sheet type is "metallic sheet", the color of the sheet may be any, but "silver" is preferred.

When it is determined that the sheet P is the "metallic sheet" (S202: Yes), the amount of heat of the non-contact heating portion 17A is set from the table in which the sheet type is the metallic sheet (S203). On the other hand, when it is determined that the sheet P is "plain sheet" (S202: No), the amount of heat of the non-contact heating portion 17A is set from the table in which the sheet type is the plain sheet (S204). For example, when the sheet P is "metallic sheet", the amount of heat of the non-contact heating portion 17A is set to be relatively high as compared with the case where the sheet P is "plain sheet" and white. When the mass of the sheet is higher than the predetermined mass, the amount of heat applied to the sheet P is set to be larger than that in a case where the mass of the sheet is lower than the predetermined mass.

As a result, when the sheet P is "metallic sheet", the amount of heat applied to the sheet P in a case where the sheet P is "plain sheet" is larger than the amount of heat applied to the sheet P in a case where the sheet P is "metallic sheet", and sufficient fixing characteristics may be obtained by increasing infrared absorptivity even when the sheet P is "metallic sheet".

Modification

Figure 10:
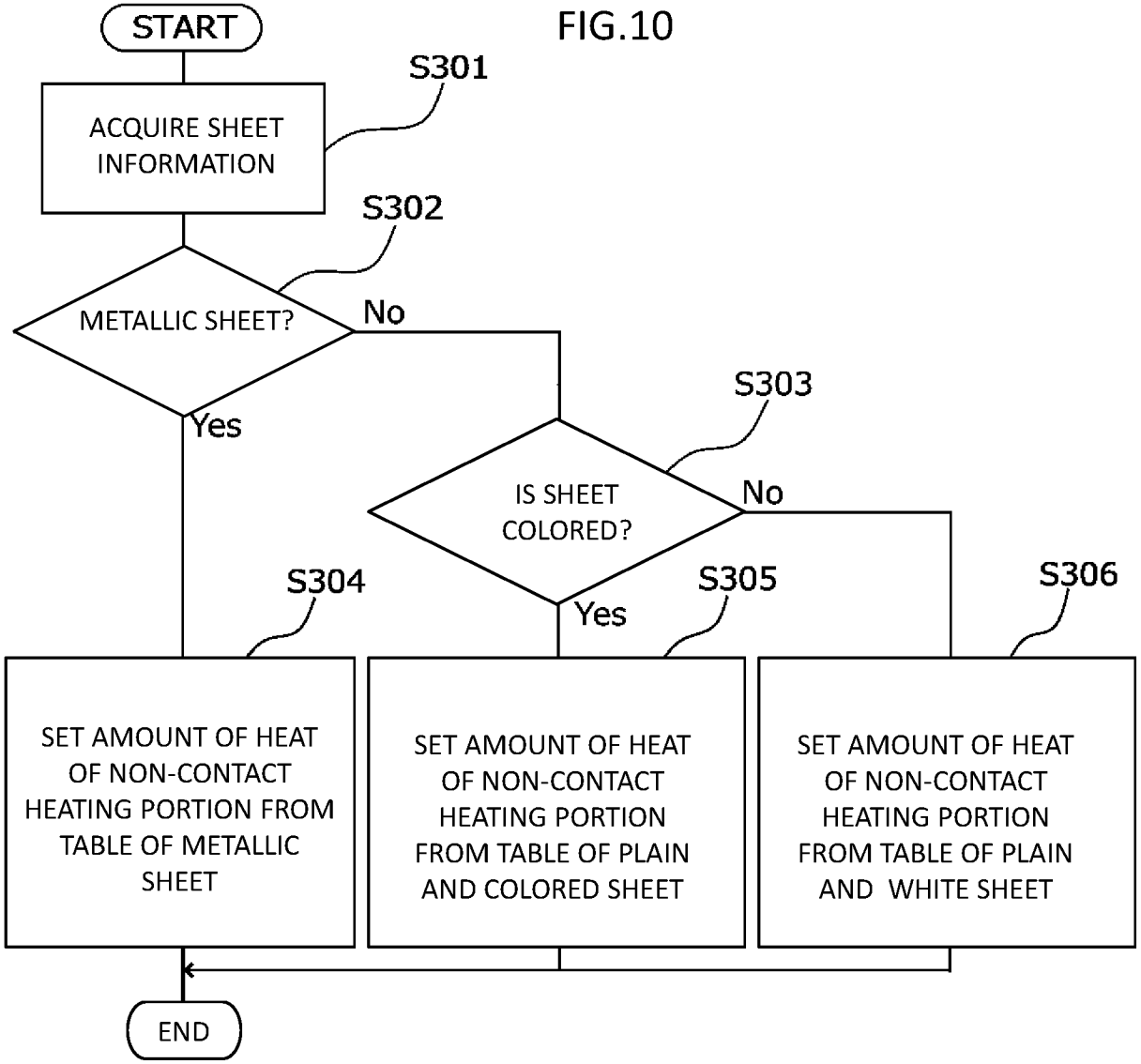
FIG. 10 is a flowchart illustrating a flow of a fixing operation according to a modification of the metallic sheet.

FIG. 10 is a flowchart illustrating a flow of a fixing operation according to a modification of the metallic sheet.

The image forming apparatus 1 acquires the sheet information of the sheet P used in the job (S301).

Next, it is determined whether or not the sheet P is a "metallic sheet" (S302). When it is determined that the sheet P is the "metallic sheet" (S302: Yes), the amount of heat of the non-contact heating portion 17A is set from the table in which the sheet type is the metallic sheet (S304). On the other hand, when it is determined that the sheet P is "plain sheet" (S302: No), it is further determined whether or not the sheet P is colored (S303). When it is determined that the sheet P is colored (S303: Yes), the amount of heat of the non-contact heating portion 17A is set from a table in which the sheet type is plain sheet and the sheet color is colored (for example, black) (S305). On the other hand, when it is determined that the sheet P is white (S303: No), the amount of heat of the non-contact heating portion 17A is set from the table in which the sheet type is plain sheet and the sheet color is white (S306). In addition, when the mass of the sheet is higher than the predetermined value, the amount of heat applied to the sheet P is set to be larger than that in a case where the mass of the sheet is low.

For example, when the sheet P is a "black sheet" of "plain sheet", the amount of heat of the non-contact heating portion 17A is set to be relatively low as compared with the case where the sheet P is a "white sheet" of "plain sheet". That is, when the sheet P is a black sheet, the amount of heat of the non-contact heating portion 17A is set to be relatively smaller than that of the white sheet.

For example, when the sheet P is a "metallic sheet", the amount of heat of the non-contact heating portion 17A is set to be relatively higher than that in a case where the sheet P is a "plain sheet" and black. That is, when the sheet P is a metallic sheet, the amount of heat of the non-contact heating portion 17A is set to be relatively larger than that of the black sheet.

Thus, when the sheet P is a "metallic sheet", the amount of heat applied to the sheet Pin the case where the sheet P is a "plain sheet" and "black" is larger than the amount of heat applied to the sheet P in the case where the sheet P is a "metallic sheet", and even when the sheet P is a "metallic sheet", the infrared absorptivity is increased and sufficient fixing characteristics may be obtained.

(3.3) Operation of Contact Fixing Portion

Figure 12:
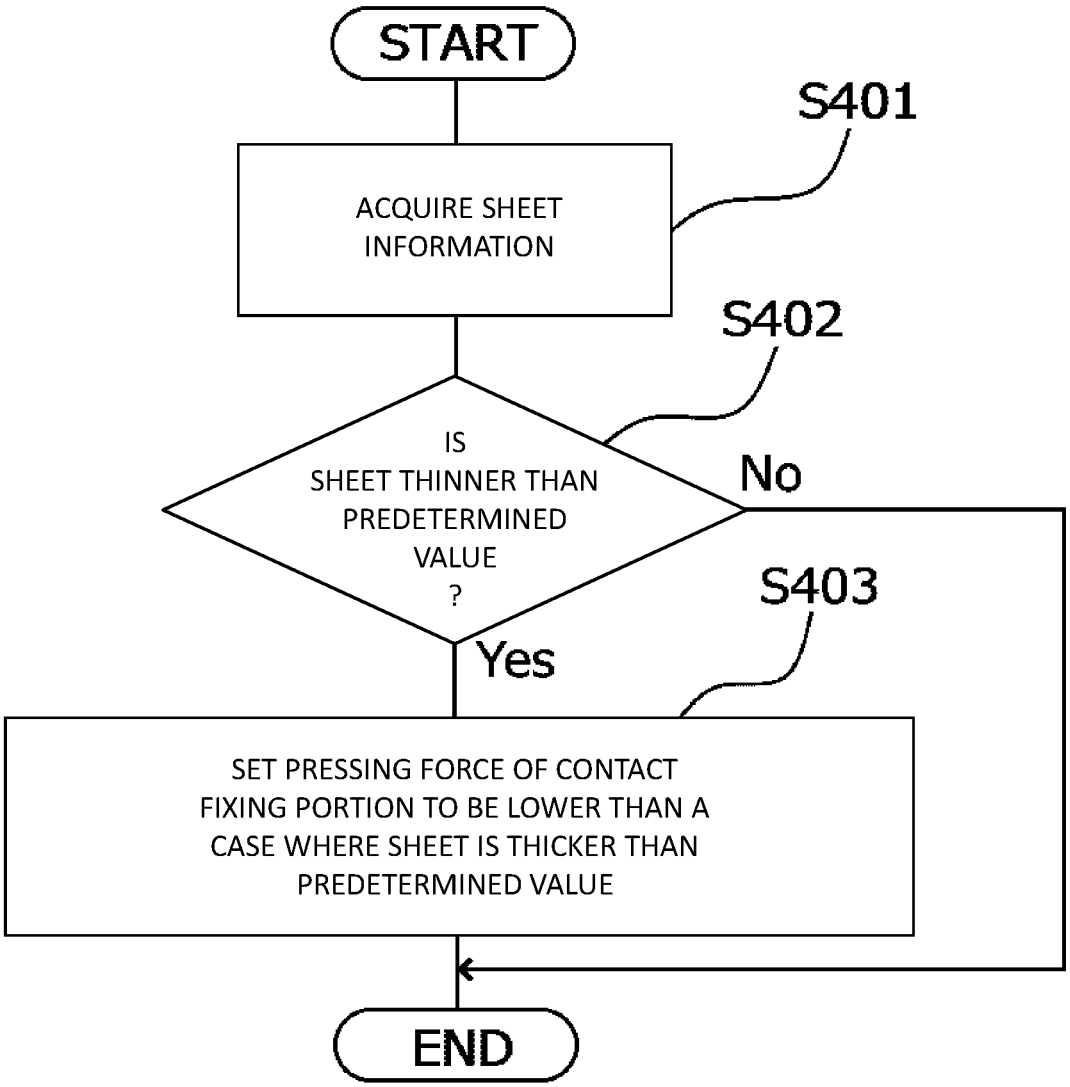
FIG. 12 is a flowchart illustrating a flow of setting of a pressing force in a contact fixing portion.

FIG. 11 is a diagram illustrating an example of a table in which the pressing condition of the contact fixing portion of the image forming apparatus 1 according to the present exemplary embodiment is set, and FIG. 12 is a flowchart illustrating the flow of setting of the pressing force in the contact fixing portion 17B.

The pressing force (nip pressure) of the contact fixing portion 17B in the image forming apparatus 1 is set such that a case where the mass of the sheet P is lower than a predetermined mass is lower than a case where the mass of the sheet P is higher than a predetermined mass, regardless of the color of the sheet P.

FIG. 11 illustrates an example of a table indicating the nip pressure condition of the contact fixing portion 17B with respect to the sheet type of sheet P (plain sheet or metallic sheet), the color of sheet (white or black), the sheet mass (60 to 79, 80 to 105, 106 to 169, 170 to 256, or 257 to 300 g/m$^2$). According to the table illustrated in FIG. 11, the pressing force of the contact fixing portion 17B is "low" (the condition that the nip pressure is low) at a predetermined sheet mass or less (105 g/m$^2$) regardless of the sheet type and the sheet color.

The image forming apparatus 1 acquires the sheet information of the sheet P used in the job (S401).

Next, it is determined whether or not the thickness of the sheet P is lower than a predetermined mass (S402). Here, as a predetermined mass, it is determined whether or not the sheet mass is smaller than "106 (g/m$^2$)". As a result, when the sheet mass of the sheet P is smaller than "106 (g/m$^2$)" (S402: Yes), the pressing force of the contact fixing portion 17B is set to "low" so as to be lower than the pressing force in a case where the sheet P is higher than the predetermined mass ("106 to 300 (g/m$^2$)") (S403). As a result, paper wrinkles of thin sheet may be suppressed.

Second Exemplary Embodiment

Figure 13:
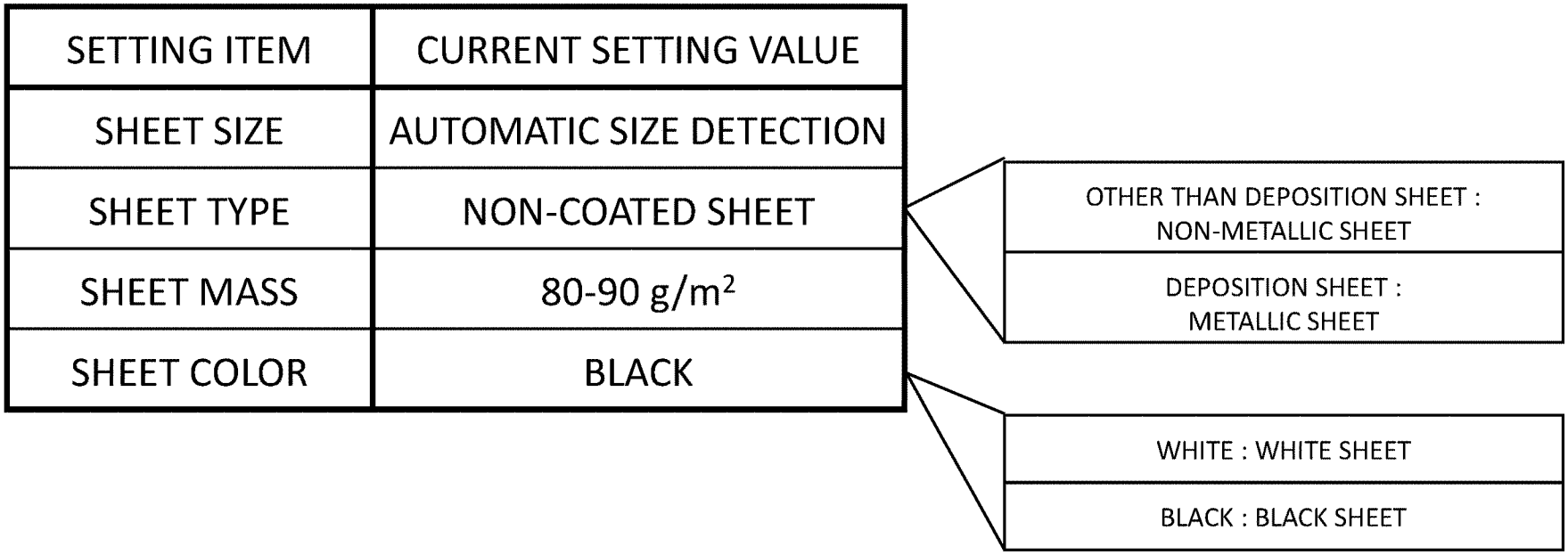
FIG. 13 is a diagram illustrating an example of sheet setting of the sheet tray of the sheet feeding device.
Figure 14:
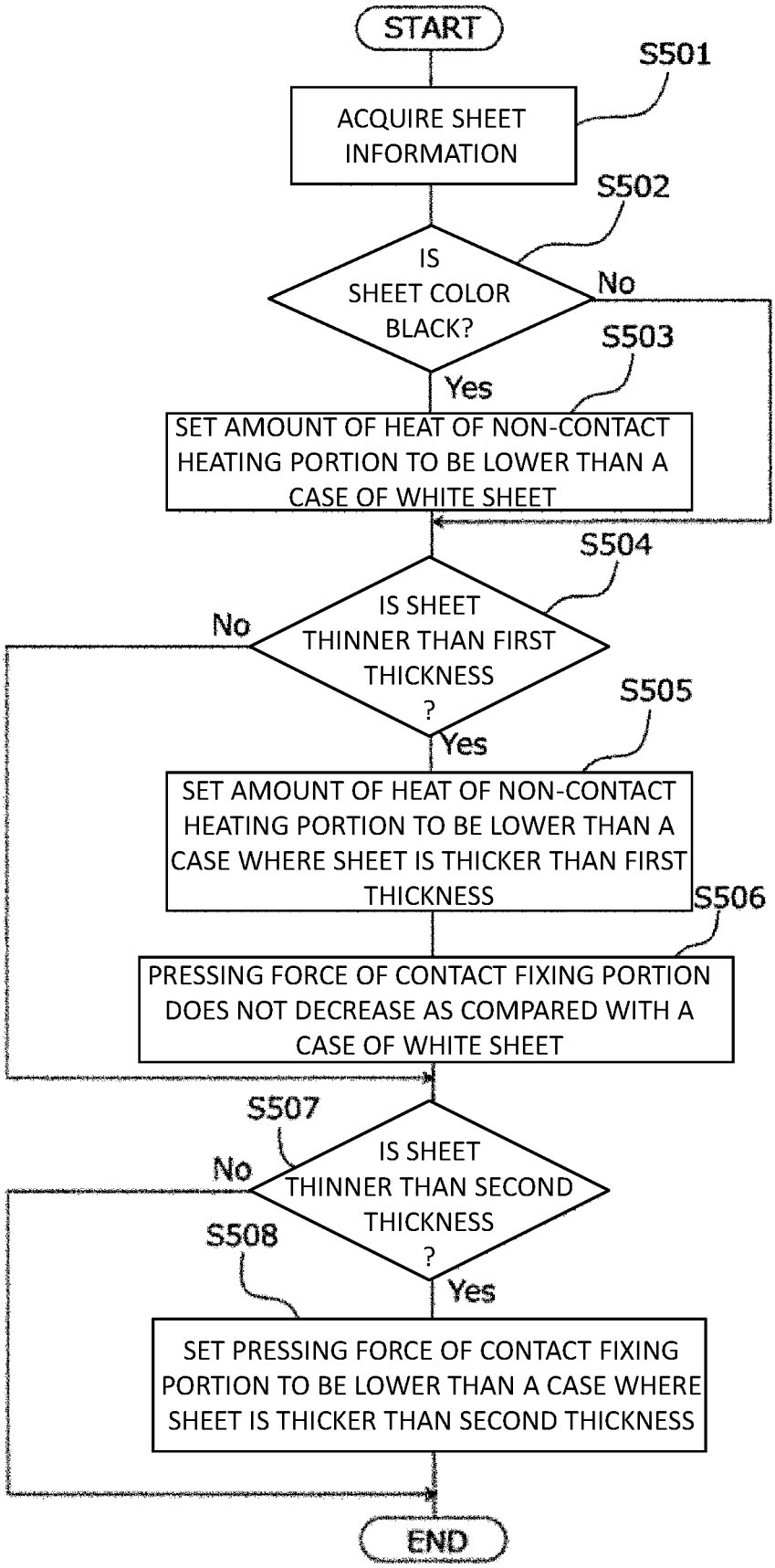
FIG. 14 is a flowchart illustrating a flow of a fixing operation of a black sheet of the image forming apparatus according to the second exemplary embodiment.
Figure 15:
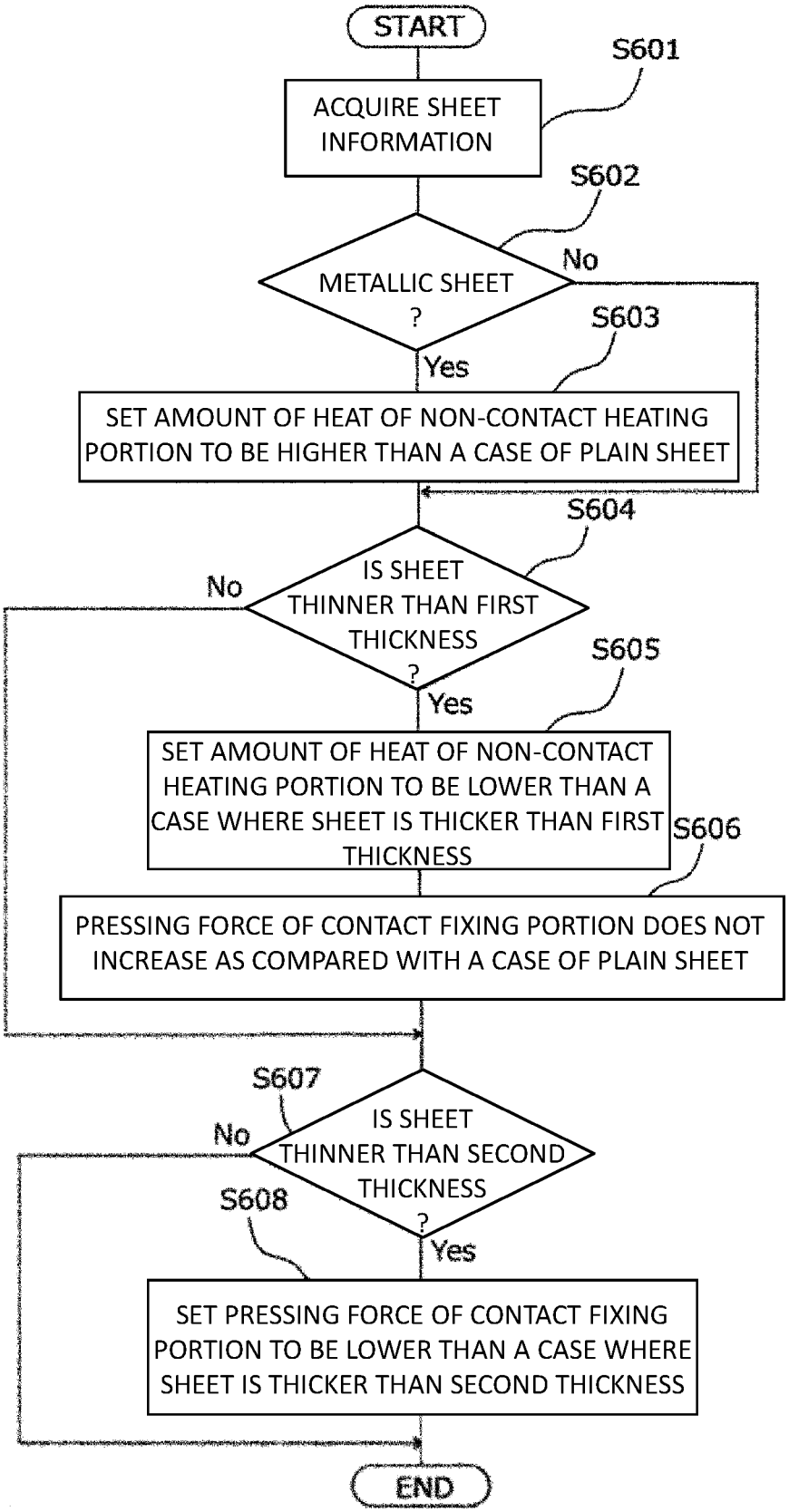
FIG. 15 is a flowchart illustrating a flow of a fixing operation of a metallic sheet of the image forming apparatus according to the second exemplary embodiment.

FIG. 13 is a diagram illustrating an example of the sheet setting of the sheet tray of the sheet feeding device 20, FIG. 14 is a flowchart illustrating the flow of the fixing operation of the black sheet of the image forming apparatus 1 according to the present exemplary embodiment, and FIG. 15 is a flowchart illustrating the flow of the fixing operation of the metallic sheet of the image forming apparatus 1 according to the present exemplary embodiment. Hereinafter, a fixing operation in the fixing device 17 will be described with reference to the drawings.

In the fixing device 17, the fixing condition (the fixing temperature at the nip portion N) in the contact fixing portion 17B is set constant, and the heating condition (amount of heat) of the non-contact heating portion 17A and the nip pressure of the contact fixing portion 17B are changed according to the mass, color, and sheet type of the sheet P being conveyed.

(1.1) Fixing Operation when Sheet Color is Black

The image forming apparatus 1 acquires the sheet information of the sheet P used in the job (S501). Examples of the sheet information include sheet type, sheet color, and sheet weight (basis weight), and as illustrated in FIG. 13, the sheet information may be acquired from sheet information specified via the operation display unit 40. For example, with respect to the "sheet type" of the setting item, when "other than the deposition sheet" is selected, the sheet type is set to "other than metallic sheet", and when the "deposition sheet" is selected, the sheet type is set to the "metallic sheet". For the sheet color, when "white" is selected, the sheet color is set to "white sheet", and when "black" is selected, the sheet color is set to "black sheet".

Next, it is determined whether or not the sheet P is "black" (S502). When it is determined that the sheet P is black (S502: Yes), the amount of heat of the non-contact heating portion 17A is set to be smaller than the amount of heat applied to the sheet P when the color of the sheet P is "white" (S503).

Next, it is determined whether or not the mass of the sheet P is lower than the first mass (S504). When the mass of the sheet P is lower than the first mass (S504: Yes), the amount of heat of the non-contact heating portion 17A is set to be smaller than when the mass of the sheet P is higher than the first mass (S505).

Here, in the present exemplary embodiment, the first mass that changes the amount of heat of the non-contact heating portion 17A by the mass of the sheet P is "169 (g/m$^2$)" as an example, and when the mass of the sheet P is higher than the first mass, the amount of heat of the non-contact heating portion 17A is set to be high, and when the mass of the sheet P is lower than the first mass, the amount of heat of the non-contact heating portion 17A is set to be low. Next, the pressing force at the nip portion N of the contact fixing portion 17B is set so as not to decrease as compared with the case where the sheet color is "white" (S506). In the present exemplary embodiment, for example, when the sheet color is "white" and the mass is the first mass "169 (g/m$^2$)", the pressing force at the nip portion N of the contact fixing portion 17B is set to "high".

Next, it is determined whether or not the mass of the sheet P is lower than the second mass (S507). As a result, when the mass of the sheet P is lower than the second mass (S507: Yes), the pressing force at the nip portion N of the contact fixing portion 17B is set to be decreased as compared with the case where the mass of the sheet is higher than the second mass (S508).

Here, in the present exemplary embodiment, the second mass that changes the pressing force of the contact fixing portion 17B by the mass of the sheet P is "106 (g/m$^2$)" as an example, the pressing force at the nip portion N of the contact fixing portion 17B is set to "high" when the mass of the sheet P is higher than the second mass, and the pressing force at the nip portion N of the contact fixing portion 17B is set to "low" when the mass of the sheet P is lower than the second mass (S507: Yes). The first mass and the second mass that are boundaries for changing the setting of the pressing force at the nip portion N of the contact fixing portion 17B are different in the present exemplary embodiment, but may be the same mass depending on the table for setting the fixing conditions.

As a result, it is possible to obtain sufficient fixing characteristics when the sheet P is black, and to suppress paper wrinkles regardless of whether or not the sheet P is black.

(1.2) Fixing Operation when Sheet Type is Metallic Sheet

The image forming apparatus 1 acquires the sheet information of the sheet P used in the job (S601), and determines whether or not the sheet P is the "metallic sheet" (S502). When it is determined that the sheet P is a metallic sheet (S602: Yes), the amount of heat of the non-contact heating portion 17A is set to be larger than the amount of heat applied to the sheet P when the sheet P is "plain sheet" (S603).

Next, it is determined whether or not the mass of the sheet P is lower than the first mass (S604). When the mass of the sheet P is lower than the first mass (S604: Yes), the amount of heat of the non-contact heating portion 17A is set to be smaller than when the mass of the sheet P is higher than the first mass (S605). Here, in the present exemplary embodiment, the first mass that changes the amount of heat of the non-contact heating portion 17A by the mass of the sheet P is "256 (g/m$^2$)" as an example, and when the mass of the sheet P is higher than the first mass, the amount of heat of the non-contact heating portion 17A is set to be high, and when the mass of the sheet P is lower than the first mass, the amount of heat of the non-contact heating portion 17A is set to be low. Next, the pressing force at the nip portion N of the contact fixing portion 17B is set so as not to increase as compared with the case where the sheet is "plain sheet" (S606). In the present exemplary embodiment, for example, when the sheet is "plain sheet" and the mass is the first mass "256 (g/m$^2$)", the pressing force at the nip portion N of the contact fixing portion 17B is set to "high".

Next, it is determined whether or not the mass of the sheet P is lower than the second mass (S607). As a result, when the mass of the sheet P is lower than the second mass (S607: Yes), the pressing force at the nip portion N of the contact fixing portion 17B is set to be decreased as compared with the case where the mass of the sheet is higher than the second mass (S608).

Here, in the present exemplary embodiment, the second mass that changes the pressing force of the contact fixing portion 17B by the mass of the sheet P is "106 ($g/m^2$)" as an example, the pressing force at the nip portion N of the contact fixing portion 17B is set to "high" when the mass of the sheet P is higher than the second mass, and the pressing force at the nip portion N of the contact fixing portion 17B is set to "low" when the mass of the sheet P is lower than the second mass (S607: Yes).

As a result, paper wrinkles may be suppressed regardless of whether or not the sheet P is a metallic sheet, while obtaining sufficient fixing characteristics when the sheet P is a metallic sheet.

According to the table illustrated in FIG. 11, the nip pressure of the contact fixing portion 17B is controlled according to the information of the sheet mass regardless of the sheet type and the sheet color information, it is also possible to determine the nip pressure according to the other information and the information of the sheet mass, regardless of the information of either one of the sheet type and the sheet color. For example, the nip pressure may be set to be higher in the case of a metallic sheet than in the case of a plain sheet, regardless of the information of the sheet color. In this case, the glossiness of the toner surface may be made close to the glossiness of the metallic sheet by fixing the toner image at a higher pressure in the case of metallic sheet while suppressing paper wrinkles regardless of the sheet color.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a non-contact heating unit configured to heat a recording medium in a non-contact manner; and a contact heating unit configured to press and heat the recording medium on a downstream side of the non-contact heating unit in a conveyance direction of the recording medium, wherein the non-contact heating unit controls an amount of heat applied to the recording medium according to information on whether the recording medium is black or not, and a thickness of the recording medium, and the contact heating unit controls the pressure applied to the recording medium according to the thickness regardless of whether the recording medium is black or not.

2. An imaging formation apparatus, comprising:

an image forming unit configured to form an image on a recording medium; and a fixing device according to claim 1.

3. A fixing device comprising:

a non-contact heating unit configured to heat a recording medium in a non-contact manner; and a contact heating unit that comes into contact with the toner on the recording medium on the downstream side of the non-contact heating unit in the conveyance direction of the recording medium, wherein the non-contact heating unit controls an amount of heat applied to the recording medium according to information on whether the recording medium is metallic sheet or plain sheet, and a thickness of the recording medium, and the contact heating unit controls the pressure applied to the recording medium according to the thickness regardless of whether the recording medium is metallic sheet or plain sheet.

4. An imaging formation apparatus, comprising:

an image forming unit configured to form an image on a recording medium; and a fixing device according to claim 3.

* * * * *